US006212846B1

(12) United States Patent
Johnston

(10) Patent No.: US 6,212,846 B1
(45) Date of Patent: Apr. 10, 2001

(54) ISOSCELES JOIST

(76) Inventor: Franklin E. Johnston, P.O. Box 291562, Kerrville, TX (US) 78029-1562

( * ) Notice: Subject to any disclaimer, the term of this patent is extended or adjusted under 35 U.S.C. 154(b) by 0 days.

(21) Appl. No.: 09/504,772

(22) Filed: Feb. 9, 2000

(51) Int. Cl.[7] ..... E04H 12/00

(52) U.S. Cl. ..... 52/648; 156/257; 52/729; 52/690

(58) Field of Search ..... 52/690; 1/696

(56) References Cited

U.S. PATENT DOCUMENTS

| | | | | |
|---|---|---|---|---|
| 3,893,276 | | 7/1975 | Brown . | |
| 3,906,571 | | 9/1975 | Zetlin . | |
| 3,978,635 | | 9/1976 | Theault . | |
| 3,991,535 | | 11/1976 | Keller . | |
| 4,178,736 | | 12/1979 | Salas . | |
| 4,195,462 | * | 4/1980 | Keller | 52/690 |
| 4,282,619 | | 8/1981 | Rooney . | |
| 4,329,827 | * | 5/1982 | Thorn | 52/793 |
| 4,336,678 | | 6/1982 | Peters . | |
| 4,349,996 | * | 9/1982 | Lautensleger et al. | 52/655 |
| 4,413,459 | | 11/1983 | Lambuth . | |
| 4,435,932 | | 3/1984 | Seaburg . | |
| 4,456,497 | * | 6/1984 | Eberle | 156/257 |
| 4,683,698 | | 8/1987 | Churchman . | |
| 4,715,162 | | 12/1987 | Brightwell . | |
| 4,821,480 | | 4/1989 | Silvey . | |
| 4,888,934 | | 12/1989 | Couture . | |
| 4,974,389 | | 12/1990 | Onysko . | |
| 5,323,584 | | 6/1994 | Scarlett . | |

OTHER PUBLICATIONS

Rick Arnold and Mike Guertin, Framing Floors With I–Joists, Fine Homebuilding, Apr./May 1997, No. 108 pp. 50—55, The Tauton Press, Inc., Newtown CT.

Paul Fisette, The Argument for I–Joists, Fine Home–building, Feb./Mar. 2000, No. 129, pp. 70–73 The Tauton Press, Inc. Newtown Ct.

Delta Joist System By Butler (Brochure) Form No. 4531–9–88, Butler Manufacturing Co., Kansas City, MO.

* cited by examiner

*Primary Examiner*—Carl D. Friedman
*Assistant Examiner*—Steve Varner

(57) ABSTRACT

An isosceles joist structural member comprising two half-joists, each half-joist comprising a pair of elongated, substantially rectangular flanges, each having a surface and a longitudinally extended groove along the diagonal of the flange, and a web disposed between the flanges, the edges are adhesively fastened within the respective continuous grooves. A joint formed into the flange at the corner, on the flange diagonal, the widest part of the flange, cooperates to make the strongest joint in the member. Two individual joists connected together forms an isosceles triangle section, and repeats connecting top to top and bottom to bottom or bottom to wall to form a roof or floor structure. Dimensional graded lumber, engineered laminated wood, or synthetic composite structural members may be used.

17 Claims, 6 Drawing Sheets

ISOSCELES JOIST

BACKGROUND—FIELD OF INVENTION

This invention relates to an isosceles joist suitable for use in construction of frame buildings as roof joists, floor joists or rafters, and particularly to wooden isosceles joists having dimensional grade lumber or engineered laminated wood flanges and webs.

BACKGROUND—DESCRIPTION OF PRIOR ART

Where strength is required in both the vertical and horizontal directions, considerable savings of weight and material cost may be accomplished by using joists arranged in the form of a triangle. This general design provides required strength to support compressive and tension loads generated by application of vertical loads to the top of the joist structure displaying the characteristics of a series of interconnected triangular truss units providing diaphragm strength for horizontal wind or seismic loads.

Various metal triangular joist arrangements are shown in prior art such as the following U.S. Patents:

| | | | |
|---|---|---|---|
| Brown | U.S. Pat. No. 3893276 | Beam and building | July 8, 1975 |
| Theault | U.S. Pat. No. 3978635 | Self-supporting element | Sept. 7, 1976 |
| Salas | U.S. Pat. No. 4178736 | Housing module and | Dec. 18, 1979 |
| Rooney | U.S. Pat. No. 4282619 | Truss structure | Aug. 11, 1981 |
| Seaburg | U.S. Pat. No. 4435932 | Alternating V-Truss | Mar. 13, 1984 |
| Lautensleger | U.S. Pat. No. 4349996 | Integrated roof system | Sept. 21, 1982 |

Metal triangular joists have a completely different design and use metal components. With this in mind, within their strength range, wooden isosceles joists are often superior. Wooden isosceles joists cost less and are more easily cut to fit. Since wooden isosceles joists don't require special fasteners, they are better adapted to wood frame construction such as homes and small commercial buildings.

There are also various wooden joists, beams, and trusses made of dimensional lumber or laminated materials shown and constructed extensively in the prior art, having a cross section resembling the capital letter "I", and called an I-beam.

| | | | |
|---|---|---|---|
| Keller | U.S. Pat. No. 3991535 | Pressed-in dovetail | Nov. 16, 1976 |
| Peters | U.S. Pat. No. 4336678 | I-Beam truss structure | June 29, 1982 |
| Lambuth | U.S. Pat. No. 4413459 | Laminated wooden | Nov. 8, 1983 |
| Eberle | U.S. Pat. No. 4456497 | Wooden I-Beam | June 26, 1984 |
| Brightwell | U.S. Pat. No. 4715162 | Wooden Joist with web | Dec. 29, 1987 |
| Onysko | U.S. Pat. No. 4974389 | Wooden Structural | Dec. 4, 1990 |
| Scarlett | U.S. Pat. No. 5323584 | Structural beam and | June 28, 1994 |

These are typically characterized by a multitude of wooden joists, beams, and trusses running parallel to one another or angled relative to one another to form a roof incline, with the webs spanning the upper and lower flanges in a vertical plane. A wooden joist, beam, or truss of this design can only carry a load imposed in the vertical direction, it cannot resist horizontal loads, such as wind or seismic. This type of structure requires cross-bracing to be stable.

Couture, U.S. Pat. No. 4,888,934, Beam structure, issued Dec. 26, 1989, shows a wood beam of V-shape cross section with a cable along the bottom designed as a retrofit to replace wood joists in floors or roof rafters, but does not use a rectangular top and bottom flange and web design.

Zetlin, U.S. Pat. No. 3,906,571, Structural member of sheet material, issued Sep. 23, 1975 shows a structural member formed entirely of sheet material with a V-shape cross section. This invention uses the stress skin design, and does not use a rectangular top and bottom flange and web design.

OBJECTS AND ADVANTAGES

One object and advantage of the present invention is to provide a structure comprised of two or more interconnected isosceles joists which are able to support loads while spanning relatively large distances.

A still further object and advantage of the present invention is to provide a structural member of the above type which has a triangular configuration suitable for imparting rigidity and strength to the structure in which it is used.

Another object and advantage of the present invention is to provide a structural member having the above characteristics and which also displays a high strength to weight ratio.

Another object and advantage of the present invention is to provide a structural member which, while possessing the above characteristics, may be fabricated from low cost recycled materials, such as plastic/wood fiber mixtures.

Another object and advantage of the present invention is to provide a structural member which, while possessing the above characteristics, may be fabricated from carbon fiber composite materials or other synthetic material which produces the strength required.

Another object and advantage of the present invention is to provide a structural member having the above characteristics, which can be put into position by erecting individual two plane half-joist sections into position on the building.

Another object and advantage of the present invention is to provide a structural member having the above characteristics, which can be put into position by assembly on the ground prior to being positioned, a multitude of isosceles joists, and lifting the assembly into position on the building.

Still another object and advantage of the present invention is to provide a lightweight, easily transportable, relatively inexpensive structural member of the above type which is comprised substantially or entirely of mass-produceable modular elements of engineered laminated wood materials.

Another object and advantage of the present invention is to provide a structural member having the above characteristics, where the need for cross-bracing between joists is eliminated and highly effective shear resistance is developed to support vertical loads at the roof or floor. Consequently, isosceles joists are inherently capable of transferring wind or seismic loads (horizontal forces in a given direction) to load support systems such as provided by adjoining walls of the structure, thereby solving a structural problem with roof systems having low diaphragm strength without the necessity for extensive cross-bracing.

Another object and advantage of the present invention is to provide a structural member having the above characteristics, which is of modular construction and whose modular elements may be prefabricated off site as two plane half-joists, each having a single top longitudinal flange and a single bottom longitudinal flange interconnected by a web fitted into a groove along the diagonal of the flange by a continuous adhesive joint, easily transported to, and easily assembled at the site consisting of diagonally disposing the half-joist sections relative to each other, where the facing surfaces of the top and bottom flange members can be juxtaposed and physically secured by a bolt during assembly.

A concomitant object and advantage of the present invention is to provide a structural member having the characteristics described above and which may be readily assembled with similar members to form a load carrying isosceles joist structure, such as the roof structure or the floor joists on a building.

The foregoing objects and advantages of the invention will become apparent from the following description of the preferred form and from the following illustrations of those forms, in which:

SUMMARY

In accordance with the present invention, a system of longitudinal flanges and webs connected along the flange diagonals, of dimensional graded lumber or engineered laminated wood material, are interconnected at each respective top flange and bottom flange which forms a composite, integrated, isosceles joist structure displaying the characteristics of a series of interconnected triangular truss units providing the rigidity and stability incident to structural triangulation. The isosceles joist develops highly efficient shear resistance to support vertical forces from roof or floor loads and horizontal forces from wind and seismic loads to a load support systems such as adjoining walls of the structure. An isosceles joist roof structure provides diaphragm strength without a structural roof decking to support a structural metal roof systems.

REFERENCE NUMERALS IN DRAWINGS

| | |
|---|---|
| 20 | flange member |
| 22 | web member |
| 23 | continuous adhesive joint |
| 24 | groove |
| 25 | web segment joint |
| 26 | web taper |
| 27 | face veneer |
| 29 | core veneer |
| 30 | bolt |
| 31 | washer |
| 32 | nut |
| 33 | joist depth |
| 34 | kerf |
| 36 | wedge |
| 38 | adhesive |
| 40 | load support system |
| 42 | ledger |
| 44 | structural metal roofing system |
| 46 | gutter |
| 48 | gutter strap support |
| 50 | structural roof decking |
| 52 | conventional roofing materials |
| 54 | floor decking |
| 56 | half-joist |

DETAILED DESCRIPTION OF THE INVENTION

Figure 1:
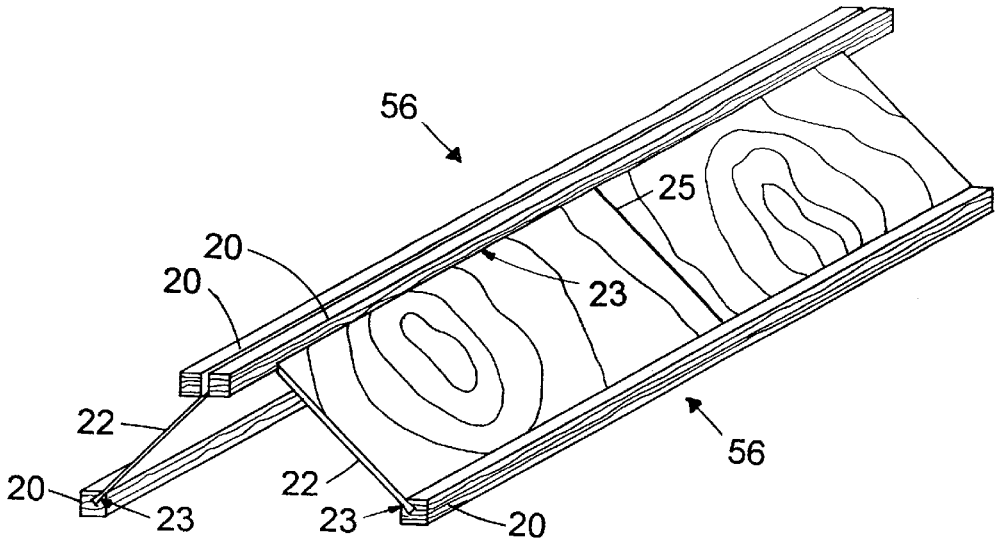
FIG. 1 is a perspective view of a preferred embodiment of two wooden half-joists joined together forming one isosceles joist member of the present invention.

As seen in FIG. 1, the isosceles joist of the present invention is a preferred embodiment comprising a pair of assembled half-joists. Each half-joist 56 comprises a top and bottom elongated, wooden flange member 20, of rectangular cross section and longitudinal grain structure, interjected by a plywood web member 22. Flange members 20 may be made, exemplarily, from nominal size structural grade lumber or laminated wood products, and the web member 22 may be made of a minimum of a three-ply laminated wood product, such as plywood, joined to flange member 20 by a continuous adhesive joint 23 along the diagonal of the flange member 20.

In the preferred embodiment, web member 22 is composed of structural grade 1 plywood, arranged with the grain of a face veneer 27 perpendicular to the length of the flange member and the grain of a core veneer 29 parallel to the length of flange member 20. The web member 22 may be composed of a plurality of segments, each having a maximum length corresponding to the length of the sheet of plywood from which it was cut. Individual web segments are joined to one another adhesively at web segment joint 25, which may be a simple butt joints, or may be of interlocking finger joint construction, common to the lumber industry.

Flange members 20 may be solid lengths of nominal sized lumber corresponding to the entire length of the finished isosceles joist, or may be made up of shorter lengths of such lumber connected end-to-end by a glued finger-joint connection common in the lumber industry. Lumber shall have a surface moisture content less than 18%.

Preferably, the engineered wooden laminate material or plywood should have a moisture content from 6% to 15% at the time of isosceles joist assembly. To avoid residual stress in the web to flange joint, the difference in moisture between the web member 22 and flange member 20 materials should preferably be less than 5% at time of assembly.

In another embodiment, web member 22 and flange member 20 are constructed of synthetic materials, such as, but not limited to, carbon fiber composite materials.

In a third embodiment, web member 22 and flange member 20 are constructed of recycled materials, such as, but not limited to, recycled plastic/wood composite materials.

Figure 2:
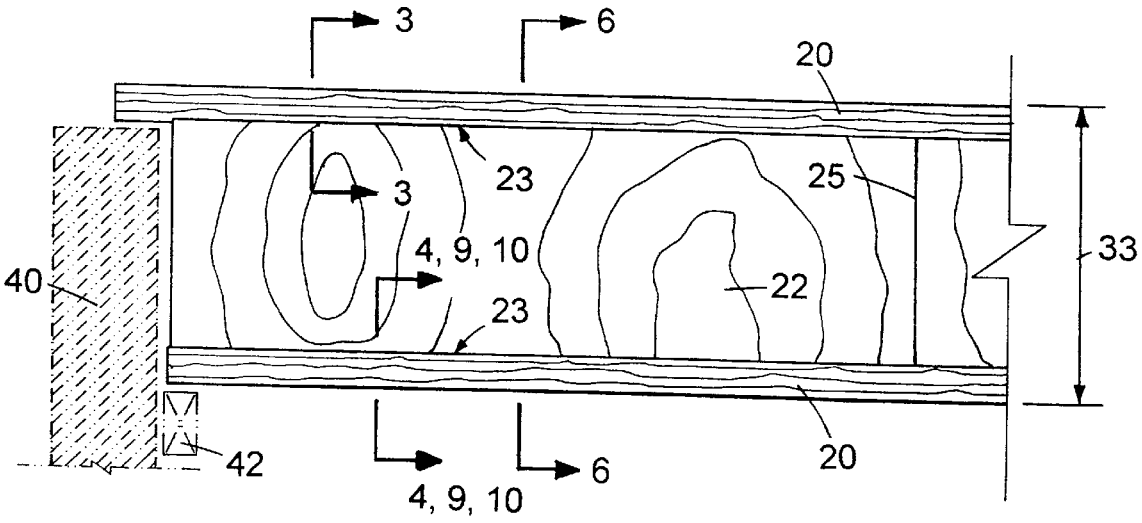
FIG. 2 is an partial longitudinal elevation view of the isosceles joist connected to a load support system, like a wall or a beam.

Referring to FIG. 2, a partial view of a typical installation of the isosceles joist of the present invention is shown in longitudinal elevation, attached to a load support systems 40, such as a wall or a beam and a ledger 42 supporting the bottom flange member 20. The web member may be cut to various widths to form the isosceles joist of different depth 33 as measured from top to bottom of the isosceles joist. Within the strength limits of the materials used, increased depth of the isosceles joist provides increased isosceles joist strength.

Figure 3:
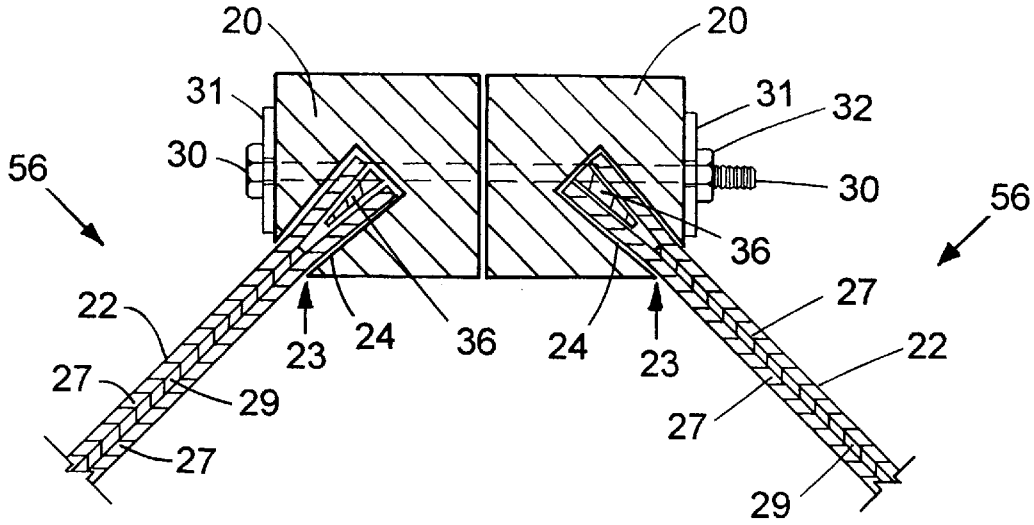
FIG. 3 is a partially cutaway sectional view of the top flange member connection and the flange-web connection taken at line 3—3 of FIG. 2.
Figure 5:
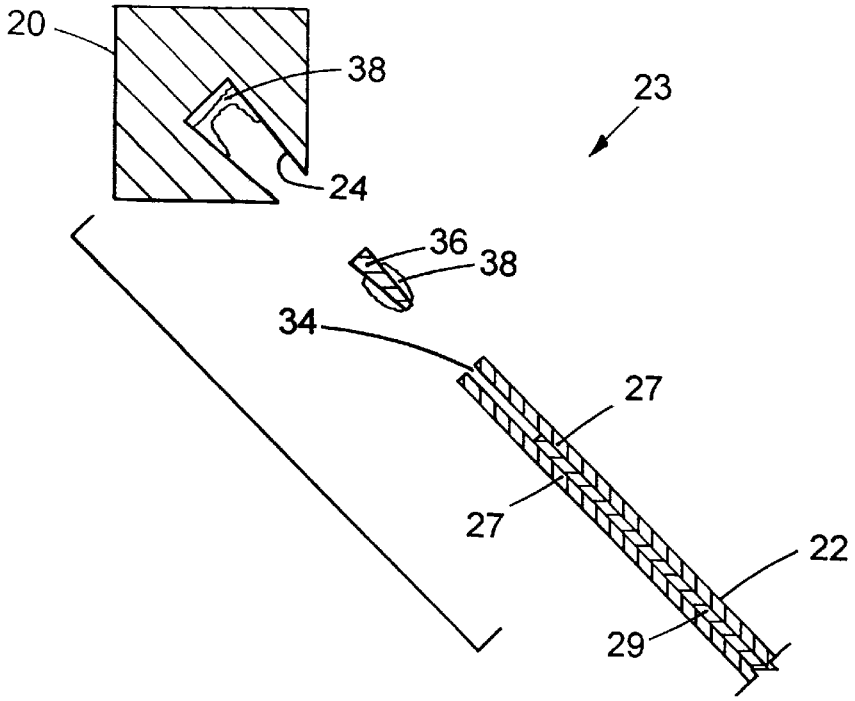
FIG. 5 is a detail of the joist construction between web and flange members of a half-joist showing a groove tapered outwardly in the depth direction, being wider at the bottom than at the surface, thus forming a self-locking dovetail joint.

As shown in FIG. 3, the continuous adhesive joint 23 between top flange member 20 and web member 22 comprises an elongated groove 24 along the diagonal of the flange members 20, the two surfaces being inclined, divergent and non-parallel relative to each other, tapering outwardly in the depth direction from the surface to the bottom, being wider at the bottom than the surface, and each end of the web member 22 having a longitudinally extending central kerf 34 as shown in FIG. 5, such that when the web member 22 is pressed into flange members 20 along their diagonal axis, the web member 22 edge is spread apart at the kerf 34 by a wedge 36 and with waterproof exterior type adhesive 38 applied therein, shall form a self-locking dovetail type joint. The two top flange members of the two half-joists 56 are physically joined with a bolt 30, washers 31 and a nut 32.

Figure 4:
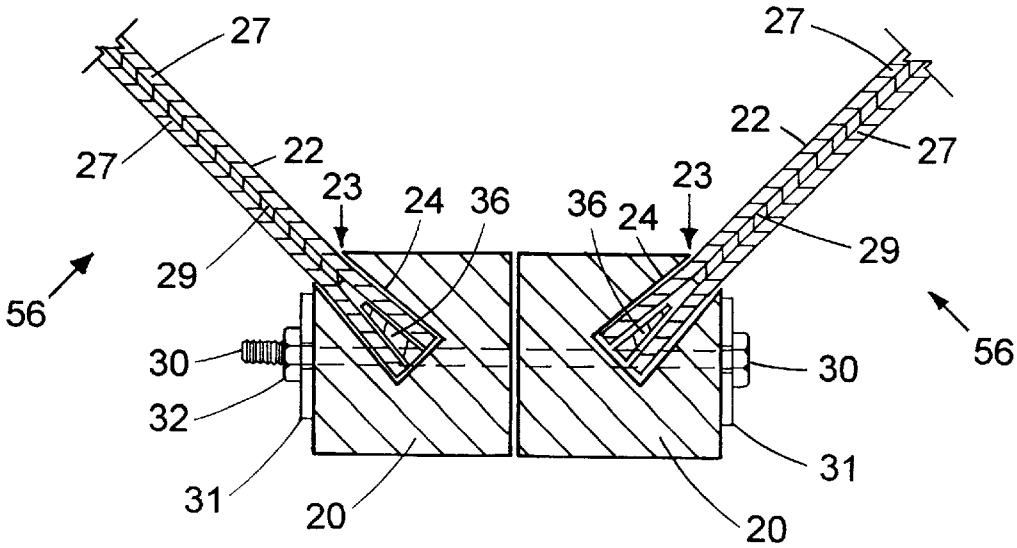
FIG. 4 is a partially cutaway sectional view of the bottom flange member connection and the flange-web connection taken at line 4—4 of FIG. 2.

As shown in FIG. 4, the continuous adhesive joint 23 between bottom flange members 20 and web member 22 comprises an elongated groove 24 along the diagonal of the flange members 20, the two surfaces being inclined, divergent and non-parallel relative to each other, tapering outwardly in the depth direction from the surface to the bottom, being wider at the bottom than the surface, and each end of the web member 22 having a longitudinally extending central kerf 34 as shown in FIG. 5, such that when the web member 22 is pressed into flange members 20 along their diagonal axis, the web member 22 edge is spread apart at the kerf 34 by a wedge 36 and with waterproof exterior type adhesive 38 applied therein, shall form a self-locking dovetail type joint. The two bottom flange members of the two half-joists 56 are physically joined with a bolt 30, washers 31 and a nut 32.

FIG. 5 shows a partially exploded sectional view of a continuous adhesive joint 23, it is seen that the flange member 20 has an elongated groove 24 and that the edge of web member 22 has a horizontal kerf 34 saw-cut continuously along the edge. When assembled with a continuous wedge 36 and waterproof exterior type adhesive 38, a self-locking dovetail type joint is formed.

The shape of the joint cross section, a self-locking dovetail type joint, formed on the diagonal or maximum dimension of the flange members 20, provides sufficient contacting surface area for good adhesion to ensure that the continuous adhesive joint 23 between the flange members 20 and the web member 22 is not the load limiting portion of the isosceles joist. The groove 24 wall slope, from flange 20 surface to bottom, out of parallelism with the axis of the web member 22, tapering outwardly in the depth direction from the surface to the bottom, being wider at the bottom than the surface. Since all material removed from the flange members 20 is on the diagonal, and is replaced by wood from the plywood web member 22, loss of flange member 20 strength because of material removal for the joint is minimized.

In the fabrication of wooden isosceles joist according to the present invention, the use of graded materials for flange and web members has been found to result in predictable and consistent isosceles joist strengths. Each flange member is preferable visually examined and mechanically tested to determine its modules of elasticity and bending resistance, and thereafter a resulting grade is assigned reflecting the maximum bending stress to which the particular piece should be subjected.

With more consistent material, it has been established that isosceles joists can be produced according to the present design which have a more reliable strength, thereby allowing the use of lighter weight isosceles joist for a given designed load, with no sacrifice of safety factor.

In construction of an isosceles half-joist 56 of the present invention, a properly prepared high quality adhesive 38, preferably a waterproof exterior type adhesive which is suitable for use in the invention will be known to those skilled in the art, such as one having a phenol, resorcinol, melamine or isocyanate base, and is applied to one or both of the surfaces to be joined. The flange grooves 24 are held in register with the web and with the wedge 36 installed therein. The isosceles half-joist 56 is pressed together to provide good surface contact.

The isosceles half-joist 56 is then held together in proper dimensional relationship until the glue cures. This may be accomplished by clamping at intervals along the half-joist 56 after assembly and pressing, and before the isosceles half-joist 56 is removed from the press, apply banding straps common in packaging lumber, around the isosceles half-joist 56 at intervals along the half-joist 56 before the isosceles half-joist 56 is removed from the pressing means.

Figure 6:
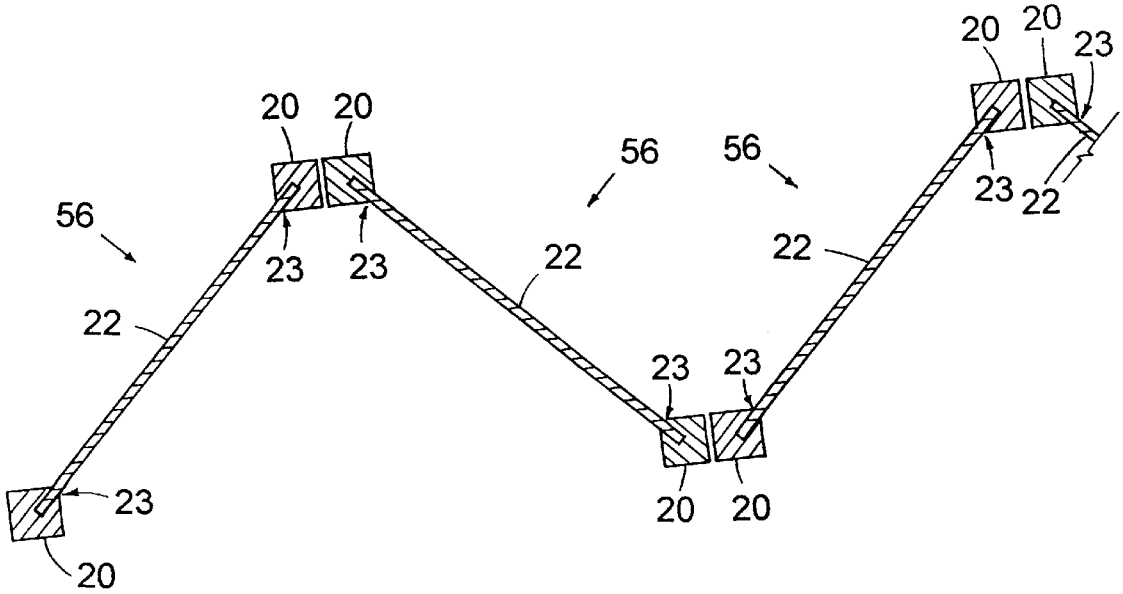
FIG. 6 is an transverse sectional view of a multitude of the isosceles joists taken at line 6—6 of FIG. 2.

As seen in FIG. 6, the isosceles joist of the present embodiment shows a transverse sectional view of a multitude of the isosceles joists. Each half-joist 56 comprises a top and bottom, elongated, wooden flange member 20, of rectangular cross section and longitudinal grain structure, interjected by a plywood web member 22. Flange members 20 may be made, exemplarily, from nominal size structural grade lumber or laminated wood products, and the web member 22 may be made of a minimum of a three-ply laminated wood product is joined to flange member 20 by a continuous adhesive joint 23 along the diagonal of the flange member 20.

Figure 7:
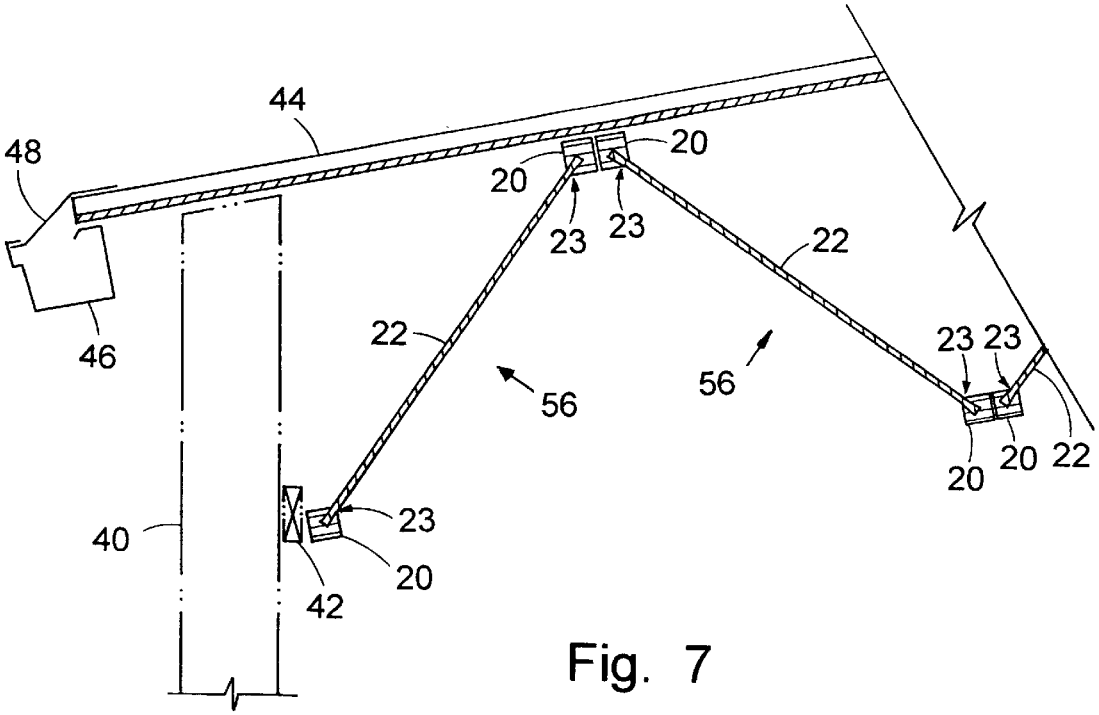
FIG. 7 is an transverse sectional view of a multitude of the isosceles joists which form purlins for the attachment of a structural metal roofing system.

Referring to FIG. 7, the isosceles joist of the present embodiment shows a transverse sectional view of a multitude of the isosceles joists which form purlins for the attachment of a structural metal roofing system 44. Each half-joist 56 comprises a top and bottom, elongated, wooden flange member 20, of rectangular cross section and longitudinal grain structure, interjected by a plywood web member 22. Flange members 20 may be made, exemplarily, from nominal size structural grade lumber or laminated wood products, and the web member 22 may be made of a minimum of a three-ply laminated wood product is joined to flange member 20 by a continuous adhesive joint 23 along the diagonal of the flange member 20. Each half-joist 56 comprises a top flange member 20 and when connected as shown in FIG. 3, forms a purlin on which a structural metal roofing system 44 may be attached.

Figure 8:
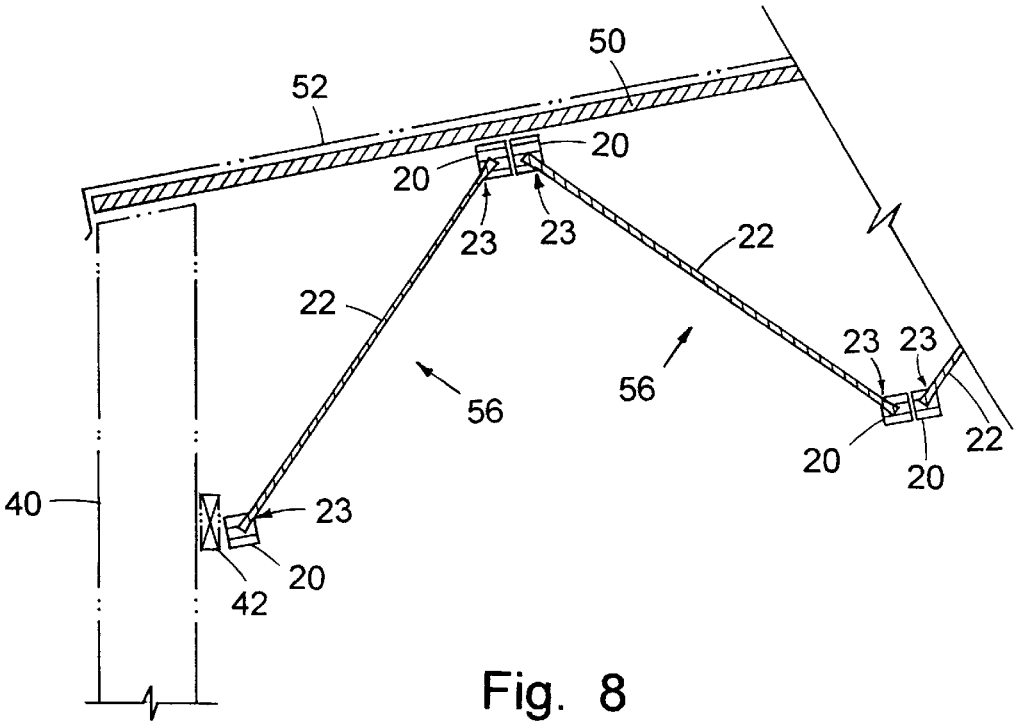
FIG. 8 is an transverse sectional view of a multitude of the isosceles joists which form rafters for the attachment of a structural roof decking upon which any conventional roofing materials may be installed.

As seen in FIG. 8, the isosceles joist of the present embodiment shows a transverse sectional view of a multitude of the isosceles joists which form rafters for the attachment of a structural roof decking 50. Each half-joist 56 comprises a top and bottom, elongated, wooden flange member 20, of rectangular cross section and longitudinal grain structure, interjected by a plywood web member 22. Flange members 20 may be made, exemplarily, from nominal size structural grade lumber or laminated wood products, and the web member 22 may be made of a minimum of a three-ply laminated wood product is joined to flange member 20 by a continuous adhesive joint 23 along the diagonal of the flange member 20. Each half-joist 56 comprises a top flange member 20 and when connected as shown in FIG. 3, forms rafters on which a structural roof decking 50 may be attached upon which any conventional roofing materials may be installed.

Figure 9:
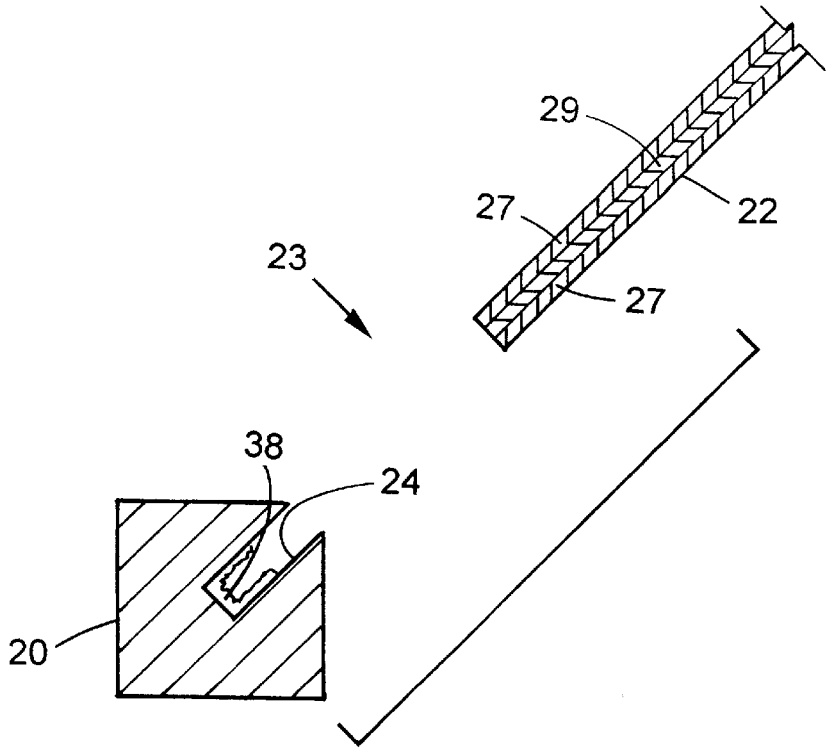
FIG. 9 is a partially cutaway sectional view of the joist construction between the web and bottom flange member of a half-joist, showing a groove whose sides are parallel, taken at line 9—9 of FIG. 2.

FIG. 9 shows a partially exploded sectional view of the continuous adhesive joint 23 between bottom flange member 20 and web member 22 comprises an elongated groove along the diagonal of the flange member 20, the two surfaces being parallel relative to each other, such that when the web member 22 is pressed into flange members 20 along their diagonal axis, the web member 22 edge is connected to the flange member 20 by means of waterproof exterior type adhesive 38 applied therein, thus forming a continuous adhesive joint.

Figure 10:
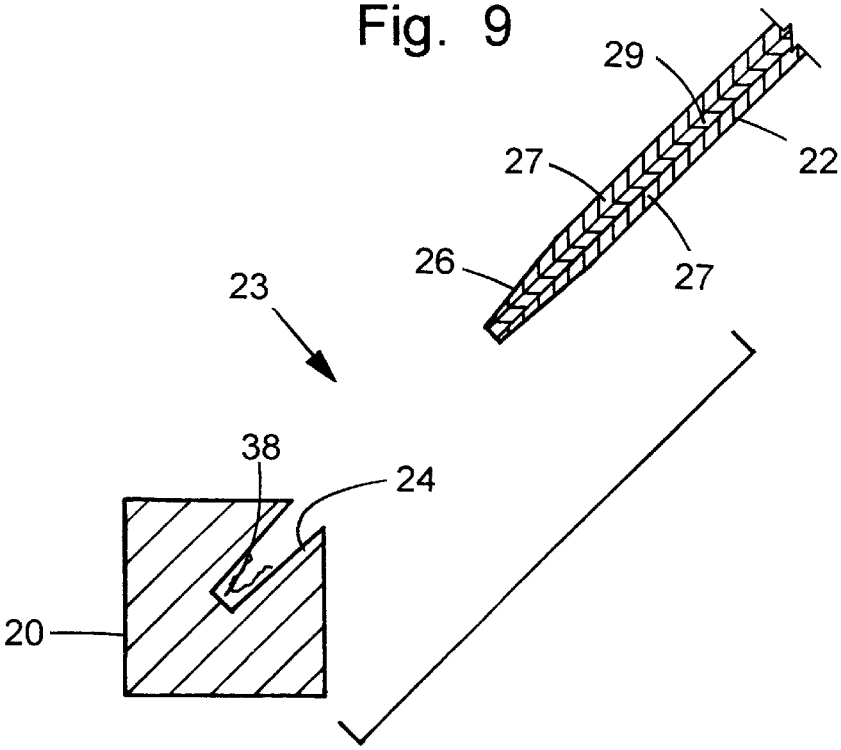
FIG. 10 is a partially cutaway sectional view of the joist construction between the web and bottom flange member of a half-joist, showing a groove tapered inwardly in the depth direction, being narrower at the bottom than at the surface, taken at line 10—10 of FIG. 2.

FIG. 10 shows a partially exploded sectional view of the continuous adhesive joint 23 between bottom flange member 20 and web member 22 comprises an elongated groove along the diagonal of the flange member 20, the two surfaces being tapered inwardly in the depth direction, relative to each other, such that when the web member 22 is pressed into flange member 20 along their diagonal axis, the web member 22 edge is tapered 26 to match the groove and connected with waterproof exterior type adhesive 38 applied therein, thus forming a continuous adhesive joint.

Figure 11:
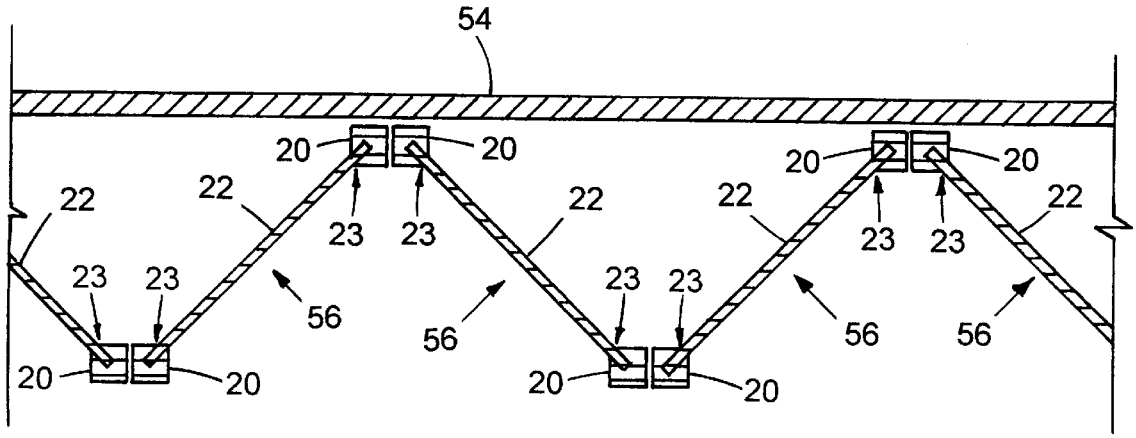
FIG. 11 is an transverse sectional view of a multitude of the isosceles joists which form a floor joist system for the attachment of floor decking.

As seen in FIG. 11, showing a transverse sectional view of a multitude of the isosceles joists which form a floor joist system for the attachment of floor decking 54. Each half-joist 56 comprises a top and bottom, elongated, wooden flange member 20, of rectangular cross section and longitudinal grain structure, interjected by a plywood web member 22. Flange members 20 may be made, exemplarily, from nominal size structural grade lumber or laminated wood products, and the web member 22 may be made of a minimum of a three-ply laminated wood product, both treated with chemicals to prevent the decay of wood by fungi, insects, or other agents, such chemicals being well known to those skilled in the art. The web 22 is joined to flange member 20 by a continuous adhesive joint 23 along the diagonal of the flange member 20. Each half-joist 56 comprises a top flange member 20 and when connected as shown in FIG. 3, forms a floor joist on which a floor deck 54 may be attached.

CONCLUSION, RAMIFICATIONS AND SCOPE OF THE INVENTION

Thus the reader will see that the isosceles joist of the present invention provides support for vertical and horizontal loads while spanning relative large distances and may be formed almost entirely of engineered laminated wood products. In addition, when the isosceles joist is installed in a building, it has a triangular configuration suitable for imparting rigidity and strength to the structure. Furthermore, the isosceles joist displays a high strength to weight ratio. The isosceles joist has the additional advantage in that

- it may be fabricated from low cost recycled materials, such as plastic and wood fiber mixtures.
- it can be erected by installing individual half-joist one at a time.
- it can be erected by assembly on the ground, a multitude of half-joists joined together, and lifting the assembly into position on the building.
- it is comprised of mass-produceable modular elements of engineered laminated wood material.
- it is comprised of mass-produceable modular elements of synthetic material.
- the need for cross-bracing between the joists is eliminated and a highly effective shear resistance is developed to support vertical loads on the floor or the roof.
- a highly effective shear resistance is developed capable of transferring wind and seismic loads to adjoining walls of the structure.
- it is of modular construction, and its modular elements may be prefabricated off site as two plane half-joists, easily transported to, and easily assembled at the site.

The terms and expressions which have been employed in the foregoing abstract and specification are used therein as terms of description and not of limitation, and there is no intention that the use of such terms and expressions of excluding equivalents of the features shown or described or portions thereof, it being recognized that the scope of the invention is defined and limited only by the claims which follow:

I claim:

1. A structural, load bearing building member, supported on bearing walls or beams, consisting of a series of isosceles joists, comprising:

a. a pair of wood flanges, elongated, rectangular, each having a surface and substantially longitudinally extended b. a wood web member connecting the said pair of flanges along their diagonal, at an angle other than 90 degrees with said surface c. means for adhesive joining said pair of flanges to said web with a joint along the said flange diagonal, whereby a half-joist is formed d. where said isosceles joist is comprised of two said half-joists, diagonally disposed to each other where their said top flanges are secured together in a face-to-face relation, and the said bottom flanges on adjacent said isosceles joists are secured together in a face-to-face relation e. where said combined top flanges are longer than the said combined bottom flanges, and set directly upon a load support system, and said bottom flanges are secured at the perimeter f. said isosceles joist structure displays composite and integrated characteristics of a series of interconnected triangular truss units providing the rigidity and stability incident to structural triangulation, providing diaphragm strength without structural roof or floor decking, whereby said isosceles joist can provide support of roof or floor structure which are secured to said top flanges.

2. The structural member as defined in claim 1, wherein the material of said flanges are chosen from lumber, machine stress rated lumber, laminated veneer lumber or parallel strand lumber.

3. The material as defined in claim 2, wherein said flanges are treated with a chemical means to prevent the decay of wood by fungi, insects, or other agents.

4. The structural member as defined in claim 1, wherein the material of said flanges are chosen from carbon fiber composite materials or other synthetic material which produces the strength required.

5. The structural member as defined in claim 1, wherein the material of said flanges are chosen from recycled material which produces the strength required.

6. The structural member as defined in claim 1, wherein the material of said web is chosen from oriented strand board, waferboard, fiberboard, or plywood.

7. The material as defined in claim 6, wherein said web is treated with a chemical means to prevent the decay of wood by fungi, insects, or other agents.

8. The structural member as defined in claim 1, wherein the material of said web is chosen from carbon fiber composite materials or other synthetic material which produces the strength required.

9. The structural member as defined in claim 1, wherein the material of said web is chosen from recycled material which produces the strength required.

10. The structural member as defined in claim 1, wherein said flange members are parallel with each other.

11. The structural member as defined in claim 1, wherein the said web is connected to the said pair of flanges by means of an adhesively secured joint in a longitudinally extended groove, along the said diagonal of the flange, where said groove having a bottom and tapering outwardly in the depth direction of the said groove, from the surface to said bottom, being wider at said bottom than at said surface, with said web having a longitudinally extended central kerf therein, and to bend said web edge apart at said kerf, out of parallelism with each other by means of a wedge and forming a self-locking dovetail type joint when said web is pressed into said pair of flanges along their said diagonal axis.

12. The structural member as defined in claim 1, wherein the said web is connected to the said pair of flanges by means of an adhesively secured joint in a groove, along the said diagonal of the flange, which is not tapered, does not form a dovetail joint, and the sides of said groove are parallel to each other when said web is pressed into said pair of flanges along their said diagonal axis.

13. The structural member as defined in claim 1, wherein the said web is connected to the said pair of flanges by means of an adhesively secured joint in a groove, along the said diagonal of the flange, where said groove having a bottom and tapering inwardly in the depth direction of the said groove, from the said surface to said bottom, being narrower at said bottom than at said surface with a matching taper on the said web, when said web is pressed into said pair of flanges along their said diagonal axis.

14. The structural member as defined in claim 1, wherein a plurality of said joist means are diagonally positioned with respect to each other and are connected at the upper and lower flanges so that the overall combination forms a configuration of isosceles triangle shapes.

15. The structural member as defined in claim 1, wherein a plurality of said joist means are diagonally positioned with respect to each other and are connected at the upper and lower flanges so that the said upper flange forms a purlin for the attachment of a structural metal roofing systems.

16. The structural member as defined in claim 1, wherein a plurality of said joist means are diagonally positioned with respect to each other and are connected at the upper and lower flanges so that the said upper flange forms a rafter for the attachment of a wood or corrugated metal roof deck upon which any conventional roofing material may be installed.

17. The structural member as defined in claim 1, wherein a plurality of said joist means are diagonally positioned with respect to each other and are connected at the upper and lower flanges so that the said upper flange forms a floor joist for the attachment of wood floor decking.

* * * * *